US007277001B2

(12) United States Patent
Mizushima et al.

(10) Patent No.: US 7,277,001 B2
(45) Date of Patent: Oct. 2, 2007

(54) COIL-EMBEDDED DUST CORE

(75) Inventors: Takao Mizushima, Niigata-ken (JP); Yutaka Naito, Niigata-ken (JP); Kazuo Aoki, Niigata-ken (JP); Hidetaka Kemmotsu, Niigata-ken (JP); Satoshi Watabe, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 15 days.

(21) Appl. No.: 11/206,113

(22) Filed: Aug. 16, 2005

(65) Prior Publication Data

US 2006/0038651 A1 Feb. 23, 2006

(30) Foreign Application Priority Data

Aug. 20, 2004 (JP) ..... 2004-241477

(51) Int. Cl.
*H01F 27/29* (2006.01)

(52) U.S. Cl. ..... 336/192; 336/200

(58) Field of Classification Search ..... 336/83, 336/200, 232, 223, 192
See application file for complete search history.

(56) References Cited

U.S. PATENT DOCUMENTS 6,774,755 B2 8/2004 Nakata et al.
2001/0016977 A1 8/2001 Moro et al.

FOREIGN PATENT DOCUMENTS

| | | | |
|---|---|---|---|
| JP | 10-125545 | | 5/1998 |
| JP | 2001-267160 | | 9/2001 |
| JP | 2002260925 A | * | 9/2002 |
| JP | 2003272922 A | * | 9/2003 |
| JP | 2004-153068 | | 5/2004 |

* cited by examiner

*Primary Examiner*—Anh Mai
(74) *Attorney, Agent, or Firm*—Brinks Hofer Gilson & Lione

(57) ABSTRACT

A coil-embedded dust core of the present invention is provided with a molded coil component including a coil main body having a structure in which a flat type conductor wire is wound edgewise, one end side terminal portion disposed by being lead in the thickness direction of the coil main body, the other end side terminal portion, one end side leading electrode portion disposed by extending the one end side terminal portion, and the other end side leading electrode portion disposed by extending the other end side terminal portion; and a dust core composed of a soft magnetic alloy powder disposed covering the coil main body, the one end side terminal portion, and the other end side terminal portion of the molded coil component.

4 Claims, 8 Drawing Sheets

COIL-EMBEDDED DUST CORE

This application claims the benefit of priority to Japanese Patent Application No. 2004-241477 filed on Aug. 20, 2004, herein incorporated by reference.

BACKGROUND OF THE INVENTION

1. Field of the Invention

The present invention relates to a coil-embedded dust core having a structure in which a metal coil is covered with a soft magnetic alloy powder compact.

2. Description of the Related Art

Requirements for small and high-performance dust cores to be mounted on electronic equipment have become intensified as miniaturization and weight reduction of the electronic equipment have been advanced. The dust core is produced by molding a soft magnetic alloy powder, e.g., a ferrite powder, having a high saturation magnetic flux density into a desired shape through compaction.

In order to produce a smaller and higher-performance inductor provided with this dust core, it has been proposed to construct a structure in which a metal coil is embedded in the inside of a dust core by embedding the metal coil in a soft magnetic alloy powder and compression-molding the entirety in that state.

The inductor having the above-described structure can be referred to as a coil-embedded dust core. In a technology known as an example of a method for producing this type of coil-embedded dust core, as shown in FIG. 10, a pressure device provided with an upper punch 103 and a lower punch 104 in a frame 102 composed of an upper frame 100 and a lower frame 101 is used, a soft magnetic alloy powder is put into a space enclosed by the above-described frame 102, the upper punch 103, and the lower punch 104, followed by being compacted, so that a lower core 106 is molded once. Subsequently, a metal coil 107 is disposed on this lower core 106, the soft magnetic alloy powder is filled in again to embed this coil 107 and, thereafter, as shown in FIG. 11, the entirety is compacted again with the upper punch 103 and the lower punch 104, so that an inductor 110 having a structure in which a metal coil 107 is embedded in the inside of a dust core 109 is produced (refer to Japanese Unexamined Patent Application Publication No. 2001-267160 corresponding to U.S. Patent Application Publication No. U.S. 2001/0016977 A1).

The inductor 110 having the structure in which the coil 107 is embedded in the inside of a dust core 109 integrally including the lower core 106 molded in advance can be produced by the method described in Japanese Unexamined Patent Application Publication No. 2001-267160.

In a technology known as another example of a structure of the above-described coil-embedded dust core and a production method therefor, as shown in FIG. 12, a coil 115 having a structure in which a coil portion 111 is formed by winding edgewise a flat type wire in such a way that a long side is arranged perpendicularly to a winding axis, and terminal portions 112 and 113 are disposed by extension at both end portion sides of the coil 115 is used and, as shown in FIG. 13, terminal portions 112 and 113 of the coil 115 are held between an upper mold 116 and a lower mold 117, so that the coil portion 111 is contained in the inside of the molds 116 and 117. A soft magnetic alloy powder 118 is filled in an inside space of the molds 116 and 117 and, thereafter, the soft magnetic alloy powder 118 is compacted with an upper punch 120 and a lower punch 121 (refer to Japanese Unexamined Patent Application Publication No. 2004-153068).

An inductor 123 having the structure in which the coil portion 111 is covered with a dust core 122 and terminal portions 112 and 113 are protruded to both sides of the dust core 122 can be produced by the method described in Japanese Unexamined Patent Application Publication No. 2004-153068. The inductor 123 is completed by bending and placing the terminal portions 112 and 113 on the bottom surface side of the dust core 122 in consideration of mounting on wiring boards and the like.

Furthermore, a structure composed of a coreless coil 131 disposed by spirally winding a tabular conductor wire 130 made of a flat type conductor wire or a foil-shaped conductor wire in such a way that the right side and the back side are faced each other, a terminal stage 132 on which the coreless coil 131 is mounted, soft magnetic alloy plates 134 and 135 to sandwich them from top and bottom, and an insulating sheet 136, as shown in FIG. 15, is known as an example of a structure of a choke coil of a type different from the coil-embedded dust core having the above-described structure (refer to Japanese Unexamined Patent Application Publication No. 10-125545 corresponding to the U.S. Pat. No. 6,774,755 B2).

When the structure of the known inductor 110 described above with reference to FIG. 10 and FIG. 11 is adopted, two steps of molding operation are required. For example, the lower core 106 is formed in the first molding by using the upper and lower punches 103 and 104 and, thereafter, the entire dust core 109 is molded again in the second molding. Therefore, there are problems in that two steps of molding operation are required, and the production is not easy.

As for the structure of the known inductor 110, the soft magnetic alloy powder is filled in around the coil 107 and are compacted while both ends 107*a* and 107*b* of the coil 107 are lead to the outside the coil 107 and are held between the upper frame 100 and the lower frame 101. Therefore, the positions of the upper and lower punches 103 and 104 must be precisely controlled in such a way that both ends of the coil 107 are not torn during compaction of the soft magnetic alloy powder with the upper and lower punches 103 and 104, the mold itself must be divided into components of the upper and lower frames 100 and 101, the configurations of the frames become complicated, the facilities become expensive, the production becomes complicated, and there is a problem in that the cost is not readily reduced. A problem similar to this problem occurs in the structure and the production method described above with reference to FIG. 12 to FIG. 14, and there is a problem in that it is difficult to produce through only one time of compaction.

As for the structure shown in FIG. 14 provided with left and right terminal portions 112 and 113, no problem occurs when the dust core 122 having an adequate vertical thickness in the thickness direction of the terminal portions 112 and 113 is disposed in the structure, as shown in FIG. 14. However, in the case where the electronic product has the dimension of about 5 mm or a few millimeters, that is smaller than 5 mm, in thickness and about 5 mm in width in accordance with the requirement for miniaturization of the electronic equipment and, therefore, the dust core 122 having an adequate vertical thickness in the thickness direction of the terminal portions 112 and 113 cannot be disposed, a load is applied to end portions of the dust core 122 when the left and right terminal portions 112 and 113 are subjected to bending, so that chipping or cracking may occur at the end portions of the dust core.

For example, since a dust core portion located under the base of the terminal portion 113 lead from the bottom side of the coil portion 111 has a particularly reduced thickness, there is a high probability that chipping or cracking may occur at this reduced thickness portion when the terminal portion 113 is subjected to bending. In particular, when the dimension of a portion including the dust core 122 is about 5 mm square in this type of inductor, the thickness of the entire dust core 122 is on the order of a few millimeters. Therefore, the above-described reduced thickness portion may become a particularly weak and brittle portion.

As for the structure of the coreless coil 131 provided with the tabular conductor wire 130 described above with reference to FIG. 15, an end portion of the tabular conductor wire 130 on the inner perimeter side of the coreless coil 131 is lead to the bottom side so as to constitute an inner terminal portion 137, an end portion of the tabular conductor wire 130 on the outer perimeter side of the coreless coil 131 is lead to the bottom side so as to constitute an outer terminal portion 138, and the top and bottom of this coreless coil 131 are sandwiched by the soft magnetic alloy plates 134 and 135. Therefore, there is a problem in that this structure cannot be a simple dust core structure. For example, if the coreless coil 131 having the above-described structure is mounted on a device provided with the upper and lower punches and the upper and lower frames and is pressurized from the top and the bottom, since the tabular conductor wire 130 is disposed in such a way that the width direction is aligned along the direction of pressurizing with the upper and lower punches, when compaction is performed at a high pressure with the upper and lower punches, the tabular conductor wire 130 having the winding structure may be partially buckled. Therefore, there is a problem in that it is essentially difficult to compact while the shape of the coil is precisely maintained.

SUMMARY OF THE INVENTION

The present invention was made in consideration of the above-described circumstances. Accordingly, it is an object of the present invention to provide a coil-embedded dust core having a configuration in which a soft magnetic alloy powder compact is disposed around a coil, the compaction state of the soft magnetic alloy powder compact portion can be made excellent even in the coil-embedded dust core miniaturized to have a size of, for example, about 5 mm or less, deformation of the coil in the inside of the dust core can be prevented and, in addition, chipping or cracking are hard to occur in the compact portion around the leading portion of the terminal portion of the coil.

Furthermore, it is an object of the present invention to provide a coil-embedded dust core having a structure in which the coil-embedded dust core can be produced through one time of compaction treatment and there is a low probability that the coil main body is deformed in the production of the coil-embedded dust core by compacting the soft magnetic alloy powder covering the coil main body.

The present invention was made in consideration of the above-described circumstances. A coil-embedded dust core of the present invention is provided with a molded coil component including a coil main body having an edgewise winding structure in which a flat type conductor wire having a flat portion is wound in such a way that a direction along the flat surface of the flat portion is arranged substantially perpendicularly to a winding axis, one end side terminal portion disposed by leading an end portion of the above-described flat type conductor wire located on one end side of the above-described coil main body in parallel to the winding axis of the coil main body, the other end side terminal portion disposed by leading an end portion of the above-described flat type conductor wire located on the other end side of the above-described coil main body in parallel to the winding axis of the coil main body, one end side leading electrode portion disposed by extending the above-described one end side terminal portion, and the other end side leading electrode portion disposed by extending the above-described other end side terminal portion; and a dust core composed of a soft magnetic alloy powder compact disposed covering the coil main body, the one end side terminal portion, and the other end side terminal portion of the molded coil component.

Since the coil main body is disposed by edgewise winding of the flat type conductor wire and both the one end side and the other end side of the flat type conductor wire are lead in parallel to the winding axis, in the case where the soft magnetic alloy powder is filled in the outside of the coil main body and is compacted, the soft magnetic alloy powder can be compacted by pressurizing in the direction of the thickness of the flat type conductor wire constituting the coil main body. In the case where the soft magnetic alloy powder is compacted, when the compaction can be performed in the thickness direction of the flat type conductor wire, as described above, the dust core can be compacted without bending or buckling the flat type conductor wire. Therefore, the coil main body can be disposed in the dust core while the original shape is precisely maintained, in contrast to that in the case where the compaction is performed in the width direction of the flat type conductor wire.

Furthermore, since the pressurization can be performed in the direction of the thickness of the flat type conductor wire constituting the coil main body in the compaction of the soft magnetic alloy powder, even when the powder is compacted while flowing in the step of compaction in accordance with the fluidity of the powder, the soft magnetic alloy powder can smoothly flow along the surface of the flat type conductor wire. Therefore, the fluidity of the soft magnetic alloy powder is not impaired in the step of compaction, and the soft magnetic alloy powder can smoothly flow into all parts around the coil main body. As a result, a dust core exhibiting no unevenness in compaction and exhibiting a uniform degree of compaction tends to be produced.

The present invention was made in consideration of the above-described circumstances. Preferably, the above-described coil main body is low-profile, the dust core covering the coil main body is low-profile, the above-described one end side terminal portion and the above-described other end side terminal portion may be lead to one surface or the other surface of the above-described dust core, the surfaces being perpendicular to the winding axis direction of the above-described coil main body.

Even in the case where both the coil main body and the dust core are made low-profile, since the coil main body is disposed by edgewise winding of the flat type conductor wire, a dust core exhibiting no unevenness in compaction and exhibiting a uniform degree of compaction can be disposed in the configuration. Since the one end side terminal portion and the other end side terminal portion are lead to one surface or the other surface of the dust core, joining or the like is readily performed in the case where the dust core is placed on a circuit board or the like and is mounted by soldering or the like. performed in the mounting on a board or the like.

The present invention was made in consideration of the above-described circumstances. The above-described one end side leading electrode portion extended from the above-described one end side terminal portion lead to the one surface or the other surface of the above-described dust core may be extended along the surface of the above-described dust core to a corner portion side of the dust core and may be bent, so that the one end side leading electrode portion may be exposed.

The present invention was made in consideration of the above-described circumstances. The above-described other end side leading electrode portion extended from the above-described other end side terminal portion lead to the one surface or the other surface of the above-described dust core may be extended along the surface of the above-described dust core to a corner portion side of the dust core and may be bent, so that the other end side leading electrode portion may be exposed.

By adopting these configurations, the electrode terminal portions can be disposed at the corners of the dust core. Consequently, joining by soldering or the like is readily performed in the mounting on a board or the like.

The present invention was made in consideration of the above-described circumstances. Both the above-described one end side terminal portion and the other end side terminal portion may be lead to one surface of the above-described dust core, the above-described other end side terminal portion may be lead keeping a distance from the outer perimeter portion of the coil main body in the inside of the dust core to the one surface of the above-described dust core, and a part of the soft magnetic alloy powder compact may be filled in between the outer perimeter portion of the above-described coil main body and the above-described other end side terminal portion.

In this manner, the soft magnetic alloy powder can be densely filled in between the outer perimeter portion of the coil main body and the other end side terminal portion.

According to the present invention, compaction can be performed without bending or crushing the flat type conductor wire constituting the coil main body, and a coil-embedded dust core including a coil main body kept in shape in the inside of the dust core can be provided. In addition, as a result of adopting the structure in which the soft magnetic alloy powder is allowed to smoothly flow into all parts around the coil main body during compaction of the soft magnetic alloy powder, a coil-embedded dust core including the dust core exhibiting no unevenness in compaction and exhibiting a uniform degree of compaction can be produced.

DESCRIPTION OF THE PREFERRED EMBODIMENTS

The embodiments of the present invention will be described below with reference to the drawings. However, the present invention is not limited to the embodiments described below.

Figure 1:
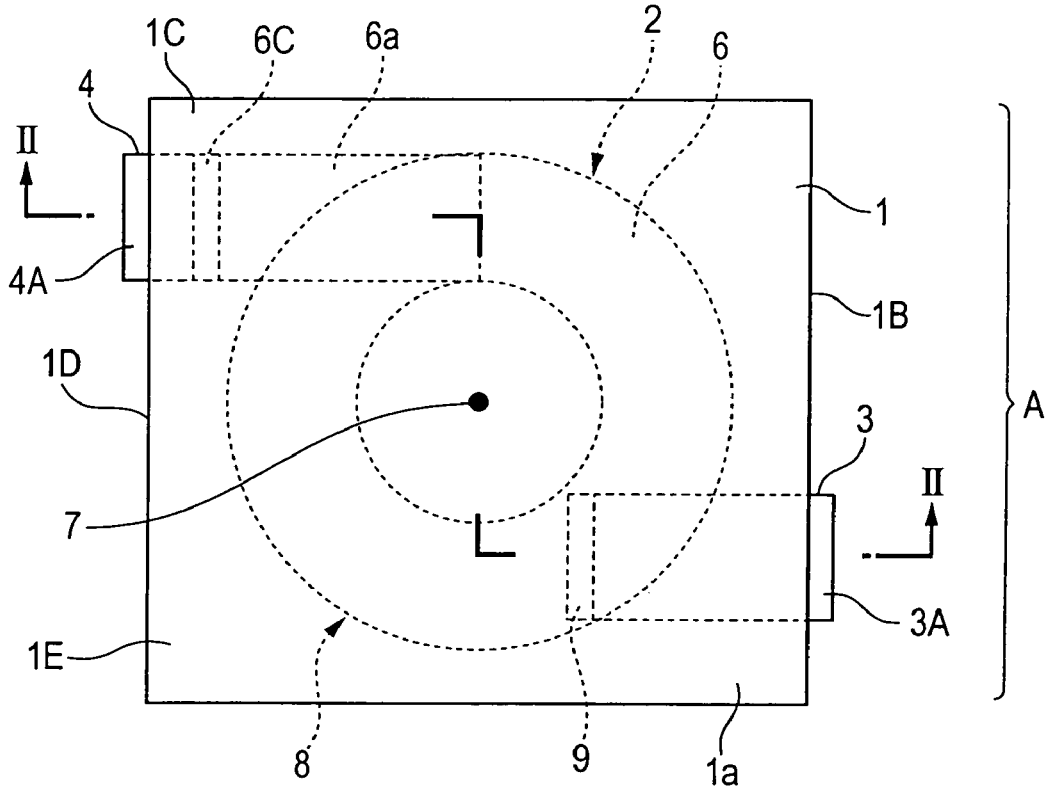
FIG. 1 is a plan view showing a coil-embedded dust core according to a first embodiment of the present invention.
Figure 2:
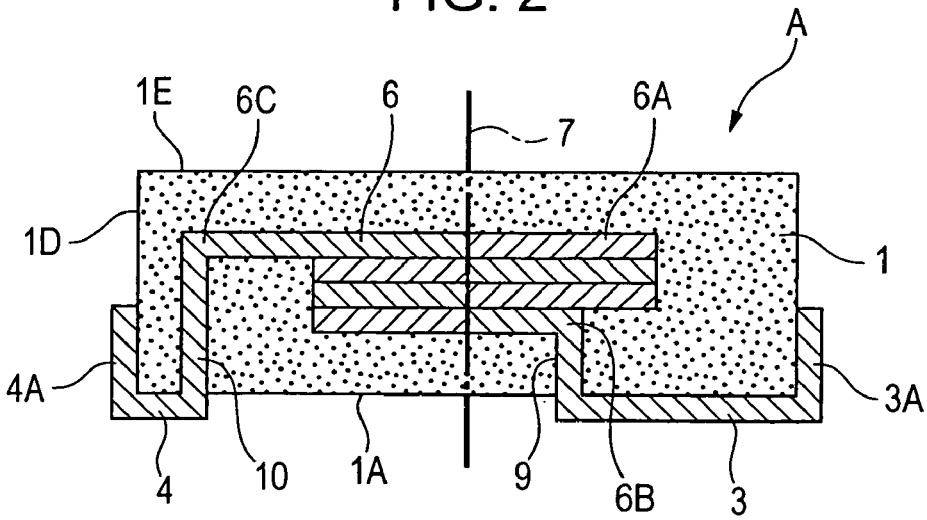
FIG. 2 is a sectional view of a section taken along a line II-II of the coil-embedded dust core shown in FIG. 1.

FIG. 1 is a plan view showing a coil-embedded dust core according to the first embodiment of the present invention. FIG. 2 is a sectional view of a section taken along a line II-II of the coil-embedded dust core shown in FIG. 1.

A coil-embedded dust core A of the present embodiment is provided with a thin tabular dust core 1 which is in the shape of a square in a plan view and which is produced by compacting a soft magnetic alloy powder, a coil main body 2 which is embedded in the inside of this dust core 1 and which is made of a conductive material, e.g., Cu, and leading electrode portions 3 and 4 disposed by individually extending the two end portions of the coil main body 2 to corner portions on the bottom surface (one surface) 1A side of the dust core 1. In the coil-embedded dust core A of the present embodiment, the vertical width and the horizontal width of the dust core 1 are specified to be, for example, about 40 mm or a few millimeters, that is smaller than 40 mm, and the thickness of the dust core 1 is specified to be 10 mm or less, for example, on the order of a few millimeters.

The above-described coil main body 2 has an edgewise winding structure in which a flat type conductor wire 6 having a flat portion 6A is wound in such a way that the flat portion 6A is arranged substantially perpendicularly to a winding axis 7. A molded coil component 8 is configured to include this coil main body 2, a lowermost layer side (one end side) terminal portion 9 disposed by leading an end portion 6B of the above-described flat type conductor wire 6 downward in parallel to the winding axis 7 of the coil main body 2, the end portion 6B located on the lowermost layer side of the coil main body 2, an uppermost layer side (the other end side) terminal portion 10 disposed by leading an end portion 6C of the above-described flat type conductor wire 6 downward in parallel to the winding axis 7 of the coil main body 2, the end portion 6C located on the uppermost layer side of the above-described coil main body 2, one end side leading electrode 3 disposed by extending the above-described one end side terminal portion 9, and the other end side leading electrode 4 disposed by extending the above-described other end side terminal portion 10.

The above-described square tabular dust core 1 is formed to have a thickness necessary to, for example, cover each of the top surface side and the bottom surface side of the coil main body 2 by at least nearly half the thickness of the coil main body 2, and the square tabular dust core 1 is formed to have a width capable of, for example, covering the outer perimeter side of the coil main body 2 by at least nearly equal to the thickness of the coil main body 2.

The one end side terminal portion 9 disposed on the lowermost layer side of the above-described coil main body 2 is disposed in such a way that the flat type conductor wire 6 located as the lowermost layer of the coil main body 2 is bent downward and extends to the bottom surface 1A side of the dust core 1 while penetrating the dust core 1 in the thickness direction of the dust core 1. The one end side leading electrode portion 3 is integrally connected to the end portion of the one end side terminal portion 9 exposed downward at the bottom surface 1A. This one end side leading electrode portion 3 is extended along the bottom surface 1A of the dust core 1 to the corner portion side of the dust core 1 in such a way that a tangent of the coil main body 2 is extended, and the end portion 3A thereof is bent upward and is laid along the side surface 1B of the dust core 1.

The other end side terminal portion 10 disposed on the uppermost layer side of the above-described coil main body 2 is bent downward in FIG. 2 from an end of a part 6*a* of the flat type conductor wire 6 extended to the outside of the uppermost layer of the coil main body 2, and is lead to the bottom surface 1A side of the dust core 1 along the outside of the coil main body 2 keeping a distance from the perimeter surface of the coil main body 2 while penetrating the dust core 1 in the thickness direction of the dust core 1. The other end side leading electrode portion 4 is integrally connected to the portion exposed at the bottom surface 1A. This other end side leading electrode portion 4 is disposed along the bottom surface 1A of the dust core 1 to another corner portion 1C side of the dust core 1 in such a way that a tangent of the coil main body 2 is extended, and the end portion 4A thereof is bent upward and is laid along the side surface 1D of the dust core 1. In the present embodiment, no terminal portion is specifically disposed on the top surface (the other surface) 1E side of the dust core 1.

Examples of preferable structures of the dust core 1 of the present embodiment can include a configuration in which a soft magnetic alloy powder is solidified and molded by a binder and, in addition, the entirety is covered by a protective layer made of a resin, e.g., a butyral-phenol resin. Examples of the above-described soft magnetic alloy powder can include a powder of soft magnetic alloy (metallic glass alloy) composed of an amorphous phase exhibiting a temperature interval ΔTx represented by an equation, ΔTx=Tx−Tg (where Tx represents a crystallization initiation temperature and Tg represents a glass transition temperature), of a supercooled liquid of 20 K or more, and containing at least P, C, B, and an element M that is at least one element selected from the group consisting of Cr, Mo, W, V, Nb, Ta, Ti, Zr, Hf, Pt, Pd, and Au, in addition to Fe as a primary component.

A desirable composition example of the above-described soft magnetic alloy powder will be described below.

$$Fe_{100-x-y-z-w-t}M_xP_yC_zB_wSi_t$$

where M represents at least one element selected from the group consisting of Cr, Mo, W, V, Nb, Ta, Ti, Zr, Hf, Pt, Pd, and Au, and x, y, z, w, t represent composition ratios and satisfy 0.5 atomic percent≦x≦8 atomic percent, 2 atomic percent≦y≦15 atomic percent, 0 atomic percent≦z≦8 atomic percent, 1 atomic percent≦w≦12 atomic percent, 0 atomic percent≦t≦8 atomic percent, and 70 atomic percent≦(100-x-y-z-w-t)≦79 atomic percent. In addition to the soft magnetic alloy powders of these composition systems, a soft magnetic alloy powder of a composition system, FeNiSnPCB, may be used.

The soft magnetic alloy powder used in the present invention is not limited to the above-described powder, and may be, for example, an amorphous soft magnetic alloy powder (metallic glass alloy powder) produced by quenching an alloy melt, the alloy having a composition of TM-Al—Ga—P—C—B—Si system or the like (TM represents a transition metal element, e.g., Fe, Co, or Ni). As a matter of course, the above-described dust core 1 may be composed of a compact of a soft magnetic alloy powder, e.g., a permalloy powder or a ferrite powder.

In the case where the above-described various metallic glass alloys are used as constituent materials of the dust cores, the powdered metallic glass alloy is usually solidified and molded together with a binder and the like so as to produce a dust core. Preferably, a butyral resin, a butyral-phenol resin, an acrylic acid resin, a silicone resin, or the like is used as the binder.

In addition to the above-described butyral resin, the butyral-phenol resin, the acrylic acid resin, the epoxy resin, and the silicone resin, examples of binders may include liquid or powdered resins and rubber, e.g., silicone rubber, a phenol resin, an urea resin, a melamine resin, and polyvinyl alcohol (PVA); water glass; oxide glass powders; and vitreous materials produced by a sol-gel method. Various elastomers (rubber) may be used as the binder.

Preferably, a lubricant selected from stearic acid salts (zinc stearate, calcium stearate, barium stearate, magnesium stearate, aluminum stearate, and the like) is used simultaneously.

The coil-embedded dust core A having the structure shown in FIG. 1 and FIG. 2 is mounted by joining the electrode portions 3 and 4 thereof to terminal portions of a circuit board by means of soldering or the like. Here, the electrode portions 3 and 4 are located at two corner portions diagonally opposite to each other on the bottom surface side of the dust core 1 and are easy-to-handle. Consequently, the joining operation to the circuit board can be readily performed.

In the coil-embedded dust core A having the structure shown in FIG. 1, as is clear from the sectional structure shown in FIG. 2, the terminal portion 9 is lead from a position that is on the bottom surface 1A side of the dust core 1 and that is adequately apart from the corner portion (corner portion side) 1*a*. Therefore, the bent portion from the terminal portion 9 to the leading electrode portion 3 can be located at a portion adequately apart from the corner portion 1*a* of the bottom surface 1A. Consequently, partial cracking or chipping does not occur in the dust core 1 when the portion from the terminal portion 9 to the leading electrode portion 3 is bent.

In the coil-embedded dust core A having the structure shown in FIG. 1, as is clear from the sectional structure shown in FIG. 2, the other end side terminal portion 10 is extended from a position on the bottom surface 1A side of the dust core 1 to the side surface 1D of the dust core 1.

Therefore, the bent portion from the other end side terminal portion 10 to the leading electrode portion 4 can be located at a distance from the corner portion 1*c* of the bottom surface 1A.

Here, in the coil-embedded dust core A having the structure shown in FIG. 1 and FIG. 2, if the other end side terminal portion 10 is directly extended to the side surface 1D side of the dust core 1 and is bent, a load may be applied to a thin portion of the dust core 1 located on the top surface side of the coil main body 2 during the bending, so that cracking or chipping may occur in this portion. In particular, the probability of occurrence of this is high in the case where the coil-embedded dust core A of the present embodiment is a small component having a thickness of a few millimeters.

This is because the dust core portion above the other end side terminal portion 10 becomes particularly thin when the other end side terminal portion 10 is directly extended from a location at the uppermost surface of the coil main body 2 to the side surface 1D side. On the other hand, when the structure in which the other end side terminal portion 10 is extended downward and is then extended from the bottom surface side of the dust core 1, as in the structure shown in FIG. 2, the thickness of the dust core present on the side surface 1D side and outside the other end side terminal portion 10 can be made larger than the thickness of the dust core 1 present above the uppermost layer of the coil main body 2. This structure has an advantage in strength and is resistant to cracking and chipping. The reason the thickness of the dust core present on the side surface 1D side and outside the other end side terminal portion 10 can be made large is that in the case where a square tabular dust core 1 of 10 mm square and a few millimeters in thickness is designed, the dimensional constraint in the thickness direction of the dust core 1 is reduced as compared with the dimensional constraint in the width direction of the dust core 1 and, therefore, the thickness of covering of the dust core 1 in the width direction can be readily increased when a low-profile coil main body 2 is covered with the dust core 1.

When a dust core portion above the uppermost layer of the coil main body 2 is formed to become particularly thick, no problem occurs in strength. The structure shown in FIG. 1 and FIG. 2 has an advantage in the case where the total thickness of the coil-embedded dust core is limited as the equipment is miniaturized, and the thickness of covering of the dust core portion formed around the coil main body 2 cannot be increased to a large extent.

Figure 3:
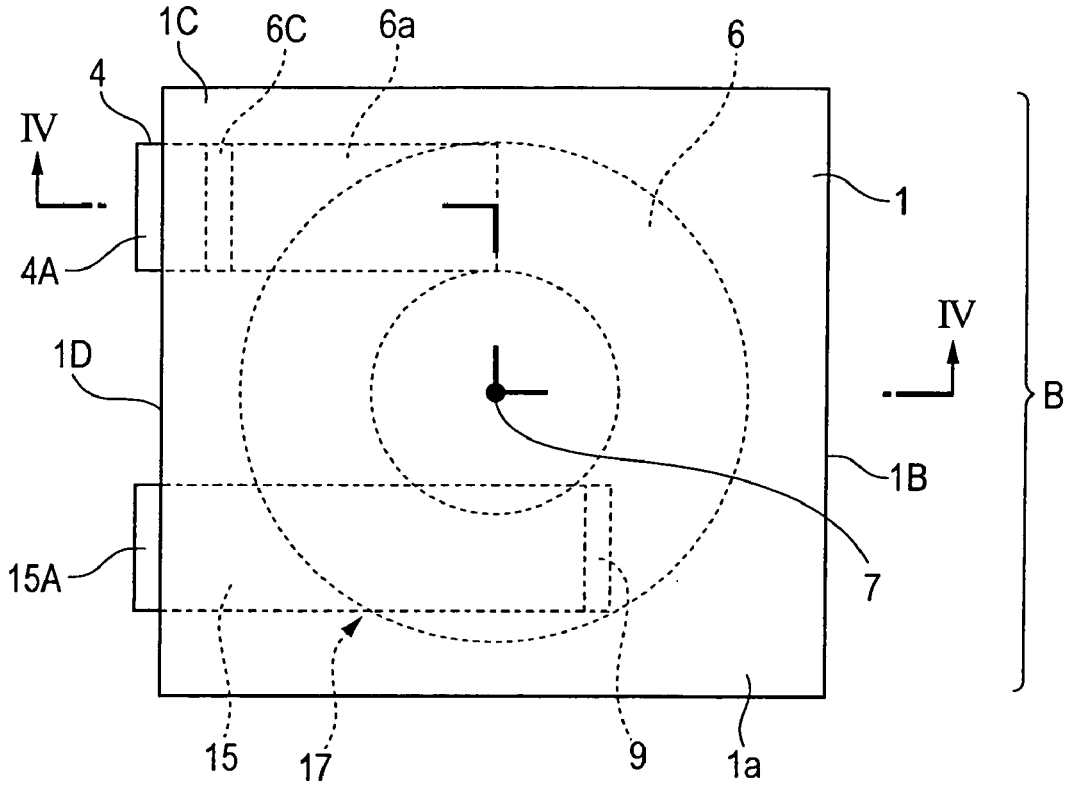
FIG. 3 is a plan view showing a coil-embedded dust core according to a second embodiment of the present invention.
Figure 4:
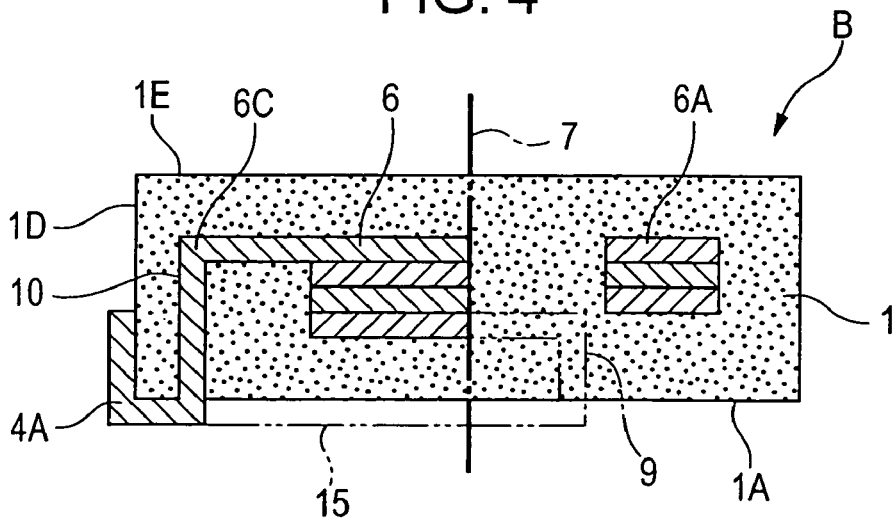
FIG. 4 is a sectional view of a section taken along a line IV-IV of the coil-embedded dust core shown in FIG. 3.

FIG. 3 is a plan view showing a coil-embedded dust core according to the second embodiment of the present invention. FIG. 4 is a sectional view of a section taken along a line IV-IV shown in FIG. 3.

In a coil-embedded dust core B shown in these drawings, the same portions as those of the coil-embedded dust core A of the above-described embodiment are indicated by the same reference numerals as in the dust core A, and explanations of the same portions are simplified.

In the structure of the present embodiment as well, similarly to the above-described embodiment, a coil main body 2 made of a conductive material is embedded in the inside of a dust core 1 composed of a soft magnetic alloy powder compact and, therefore, the basic structure is equal.

In the present embodiment, the coil main body 2 has the structure in which the flat type conductor wire 6 is wound edgewise and that the coil main body 2, the terminal portion 10, and the leading electrode portion 4 are all disposed as in the above-described embodiment. However, in the present embodiment, a leading electrode portion 15 disposed by extending from the terminal portion 9 is extended in a direction opposite to the above-described leading electrode portion 3, that is, the leading electrode portion 15 is extended to the side surface 1D side of the dust core 1 while the end portion 15A thereof is in the shape of being bent upward along the side surface 1D, so that a molded coil component 17 is constructed.

As for the structure of this second embodiment, the effect similar to those of the structure of the above-described embodiment can be exhibited. Since the coil-embedded dust core B of the second embodiment includes two electrode portions 4A and 15A on the side surface 1D side of the dust core 1, when the dust core is mounted on a circuit board or the like, joining can be performed with the electrode portions 4A and 15A disposed close to each other.

Figure 5:
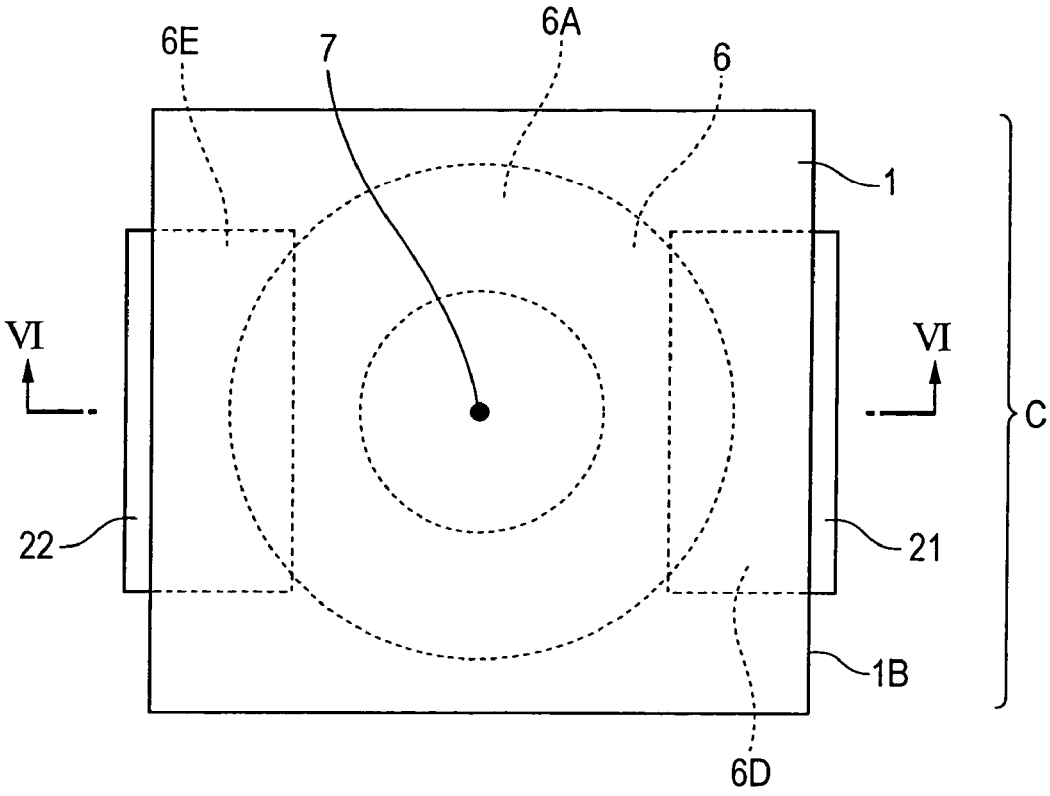
FIG. 5 is a plan view showing a coil-embedded dust core according to a third embodiment of the present invention.
Figure 6:
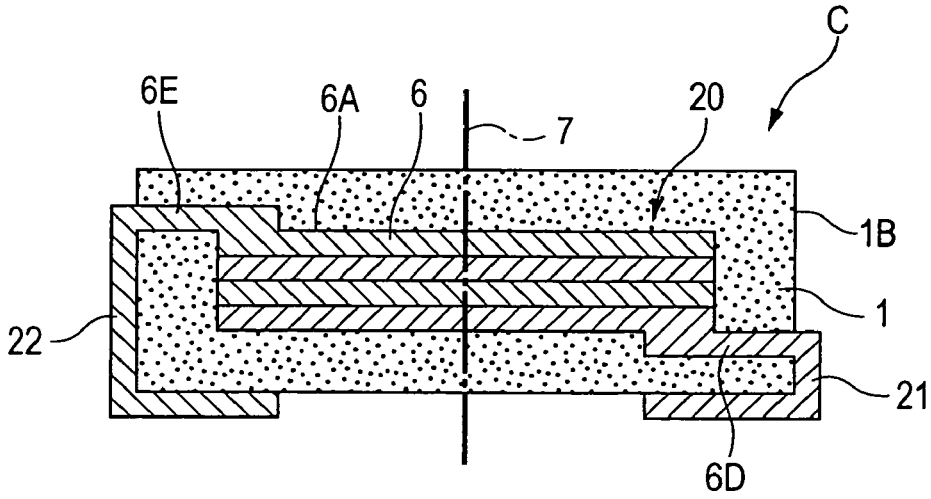
FIG. 6 is a partial sectional view of a section taken along a line VI-VI of the dust core portion in the coil-embedded dust core shown in FIG. 5.

FIG. 5 is a plan view showing a coil-embedded dust core according to the third embodiment of the present invention. FIG. 6 is a partial sectional view of a section taken along a line VI-VI of only the dust core portion shown in FIG. 5.

In a coil-embedded dust core C shown in these drawings, the same portions as those of the coil-embedded dust core A of the above-described embodiment are indicated by the same reference numerals as in the dust core A, and explanations of the same portions are simplified.

In the structure of the present embodiment as well, similarly to the above-described embodiment, a coil main body 20 composed of a flat type conductor wire 6 made of a conductive material, e.g., Cu, is embedded in the inside of a dust core 1 composed of a soft magnetic alloy powder compact and, therefore, the basic structure is equal.

In the coil main body 20 of the present embodiment, an end portion of the flat type conductor wire 6 of the lowermost layer is extended as one end side terminal portion in a direction parallel to the winding axis 7, and is further extended as one end side terminal portion 6D to the outside of the coil main body 20 to be exposed at the side surface 1B side of the dust core 1, followed by being bent downward, so that a leading electrode portion 21 is formed. An end portion of the flat type conductor wire 6 of the uppermost layer is extended as the other end side terminal portion in a direction parallel to the winding axis 7, and is further extended as the other end side terminal portion 6E to the outside of the coil main body 20 to be exposed at the side surface 1D side of the dust core 1, followed by being bent downward, so that a leading electrode portion 22 is formed. Those having a shape in which the end portion of the flat type conductor wire 6 constituting the coil main body 20 is extended once in parallel to the winding axis 7 and is further extended toward the outside of the coil main body 20, as in the present embodiment, are also included in the concept of the present invention.

As for the structure of the present embodiment an effect similar to that of the structure of the above-described embodiment can be exhibited. In the structure of the present invention, since the thickness of the dust core 1 on the bottom surface side of the end portion 6D of the flat type conductor wire 6 and the thickness of the dust core 1 on the top surface side of the end portion 6E of the flat type conductor wire 6 are somewhat small, the above-described problems may occur when the end portions are bent. However, the structure has no specific problem when the size is configured such that the thickness of the dust core 1 can be adequately ensured. Other effects are similar to those of the structure in the above-described embodiment.

An example of a method for manufacturing the coil-embedded dust cores A and B having the structures described with reference to the above-described FIGS. 1 and 2 and FIGS. 3 and 4 will be described below.

These coil-embedded dust cores A and B can be produced basically by forming the terminal portions through downward extension under the coil main body 2 in which the flat type conductor wire 6 is wound edgewise, forming the dust core 1 while surrounding this coil main body 2, and bending the terminal portions protruding from the dust core 1 along the dust core 1 so as to form each of the leading electrode portions.

Figure 7:
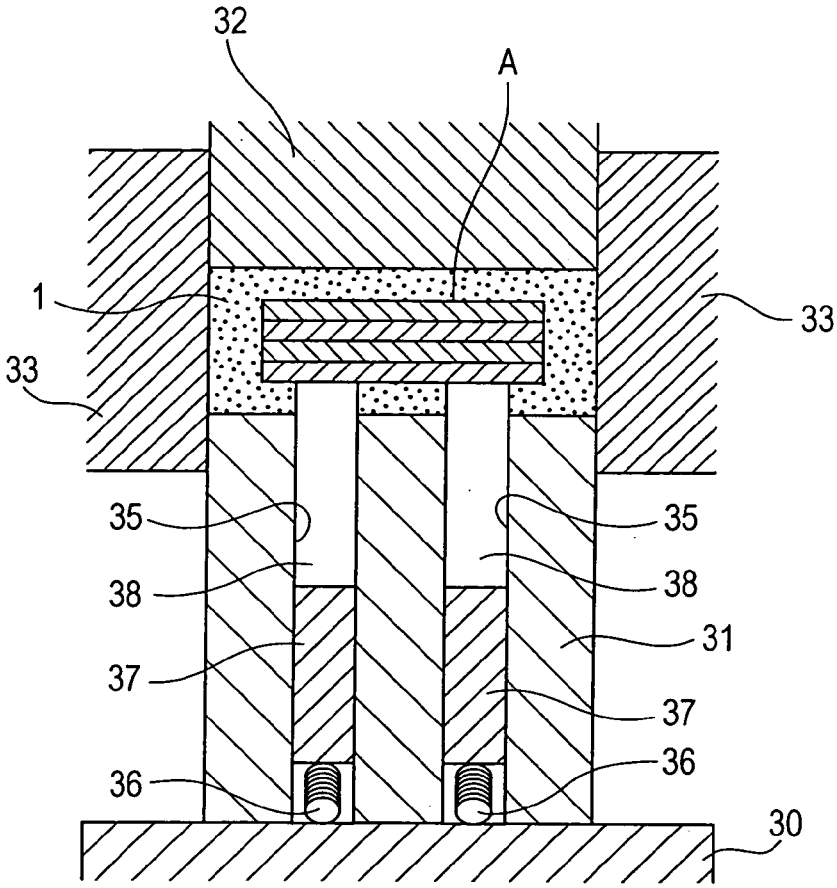
FIG. 7 is a sectional view of an example of a device suitable for the use in production of a coil-embedded dust core according to the present invention.

FIG. 7 shows an example of a device applicable to the production of the coil-embedded dust cores A and B having the above-described structure.

The device shown in FIG. 7 has the configuration in which a lower punch 31 is disposed on a stage 30, and a vertically movable upper punch 32 is disposed above this lower punch 31, a hollow die 33 is disposed to surround these upper and lower punches 31 and 32, a soft magnetic alloy powder is filled in a space formed between the upper punch 31 and the lower punch 32 and between these punches 31 and 32 and the die 33 surrounding them, and the soft magnetic alloy powder between the upper punch 31 and the lower punch 32 can be compacted by moving downward the upper punch 32.

In the device of the present embodiment, discrete storage holes 35 and 35 are disposed in vertical directions in the inside of the lower punch 31, elastic materials 36, e.g., springs, and pins 37 are stored in the inside of these storage holes 35, and holes having a size capable of storing two terminal pieces 38 of the molded coil component for producing the coil-embedded dust cores A and B are disposed above the pins 37 in the storage hole 35.

The coil-embedded dust core A is produced by using the device shown in FIG. 7. The flat type conductor wire 6 having a flat portion 6A is wound edgewise in such a way that the flat portion 6A is arranged substantially perpendicularly to the winding axis 7 so as to form the coil main body 2. An uppermost layer portion of the flat type conductor wire 6 constituting the coil main body 2 is bent downward to form one terminal piece 38, and a lowermost layer portion of the flat type conductor wire 6 constituting the coil main body 2 is bent downward to form the other terminal piece 38. The one terminal piece 38 of the coil main body 2 in this state is stored in the hole of the one storage hole 35 of the lower punch 31, and the other terminal piece 38 is stored in the hole of the other storage hole 35 of the lower punch 31. A soft magnetic alloy powder is filled in around the coil main body 2 in this state. Subsequently, the upper punch 32 is moved downward to compact the soft magnetic alloy powder together with the lower punch 31, so that the dust core 1 is molded.

In this compaction treatment, the soft magnetic alloy powder located under the coil main body 2 and compacted while being sandwiched between the top surface of the lower punch 31 and the bottom surface of the coil main body 2 has fluidity in some degree and smoothly reaches all parts on the bottom surface side along the bottom surface (the flat surface of the flat type conductor wire 6) of the coil main body 2, so that the soft magnetic alloy powder can be compacted while the soft magnetic alloy powder extends throughout these parts. If the soft magnetic alloy powder located under the coil main body 2 cannot flow smoothly, a partial shortage of the soft magnetic alloy powder occurs on the bottom surface side of the coil main body 2, and the thickness of the covering becomes smaller than a desired thickness. Consequently, the soft magnetic alloy powder compact portion having a desired thickness may not be formed around the coil main body 2. In this regard as well, the structure in which the flat type conductor wire is wound edgewise has an advantage.

After the dust core 1 is molded, the upper punch 32 is moved upward, and the dust core 1 is taken out of the lower punch 31. Each of the terminal pieces 38 and 38 protruded to the bottom surface side of the dust core 1 is bent along the bottom surface of the dust core 1, and end portions thereof are further bent along the side surface of the dust core 1, so that the coil-embedded dust core A shown in FIG. 1 can be produced.

In the case where the dust core 1 is molded, the shape of the coil set into the above-described device is specified to be the molded coil component 17 shown in FIG. 3 and FIG. 4, the directions of bending of the terminal pieces after compaction are changed and, thereby, the coil-embedded dust core B having the structure shown in FIG. 3 can be produced.

When the coil-embedded dust cores A and B are produced by using the above-described device, since the dust core 1 can be produced through one time of compaction operation, the coil-embedded dust cores A and B can also be readily produced.

Figure 10:
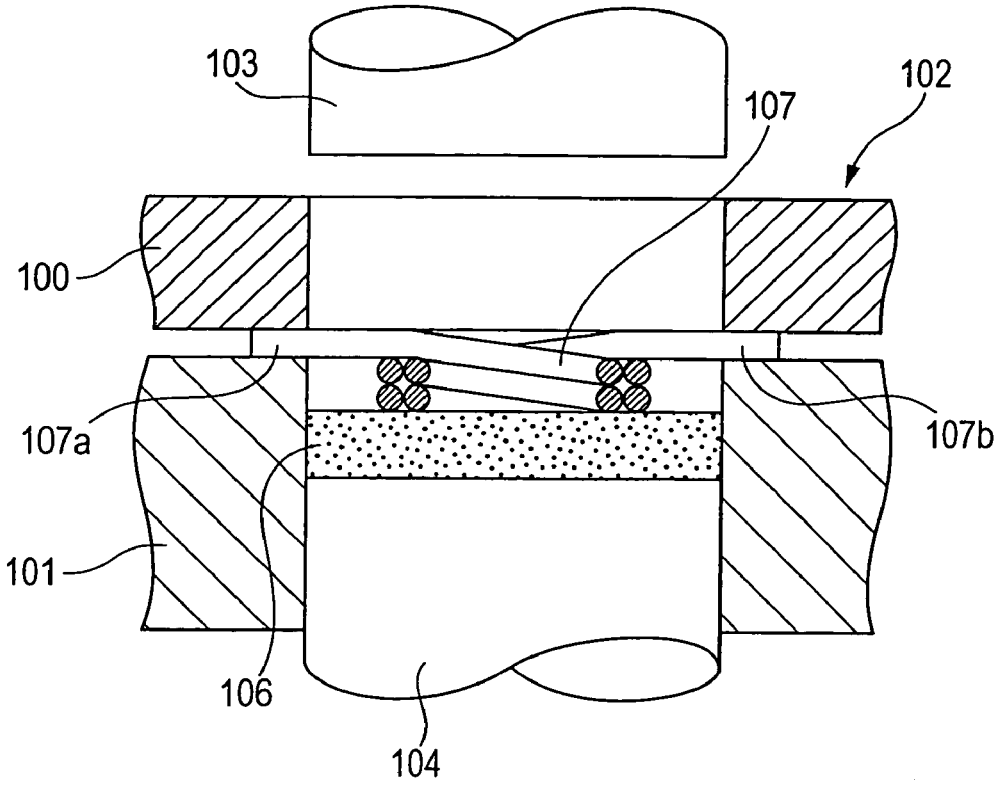
FIG. 10 PRIOR ART
FIG. 10 is a sectional view showing the state after a first compaction is performed in a method for producing a known coil-embedded dust core.
Figure 11:
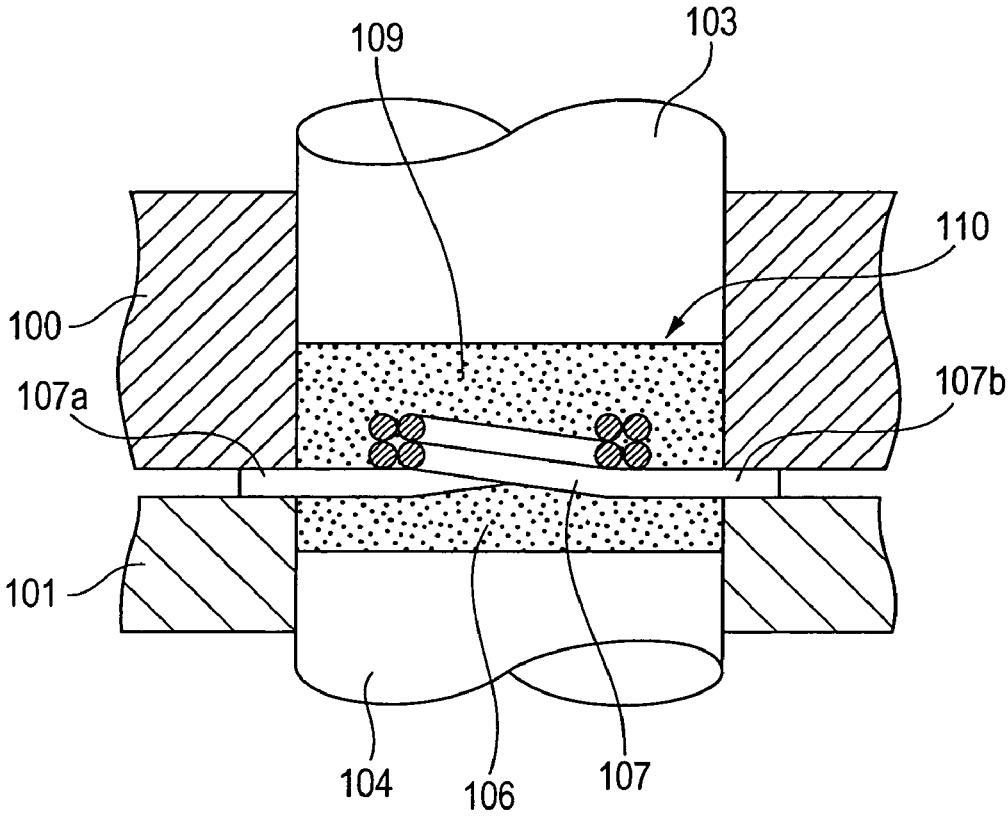
FIG. 11 PRIOR ART
FIG. 11 is a sectional view showing the state after a second compaction is performed in the method for producing a known coil-embedded dust core and an example of the resulting coil-embedded dust core.
Figure 12:
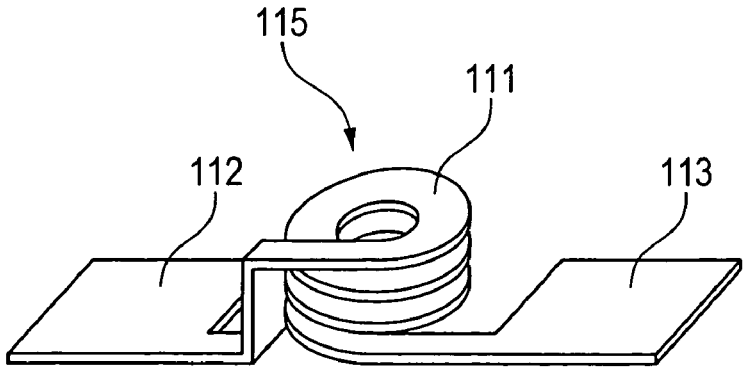
FIG. 12 PRIOR ART
FIG. 12 is a perspective view of a coil main body applied to the production of another example of known coil-embedded dust cores.
Figure 13:
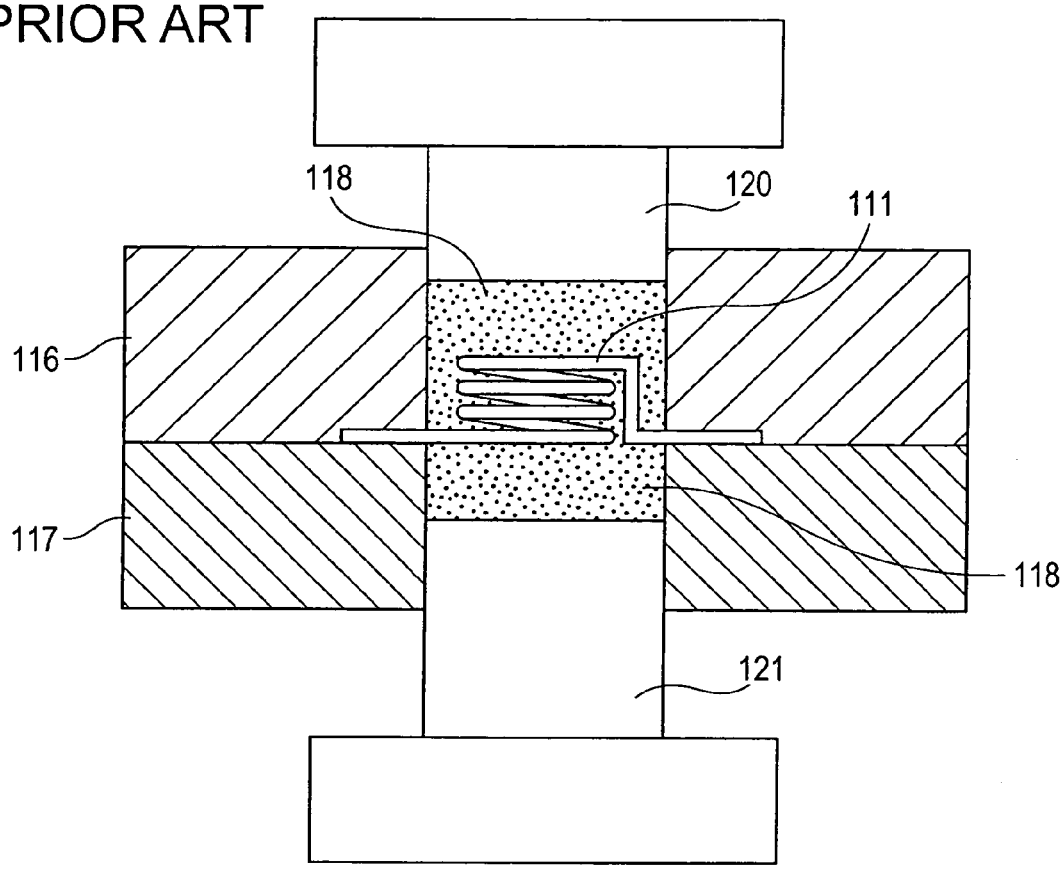
FIG. 13 PRIOR ART
FIG. 13 is a sectional view showing the state in which compaction is performed after a powder is filled in around the coil main body shown in FIG. 12.
Figure 14:
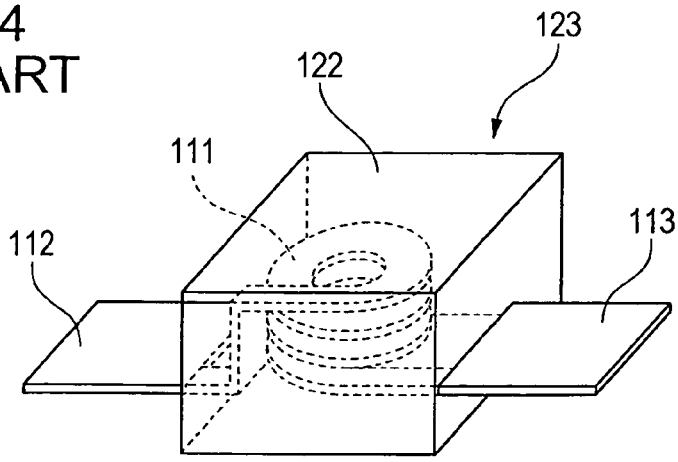
FIG. 14 PRIOR ART
FIG. 14 is a perspective view of a coil-embedded dust core produced by completing the compaction following the state shown in FIG. 13.
Figure 15:
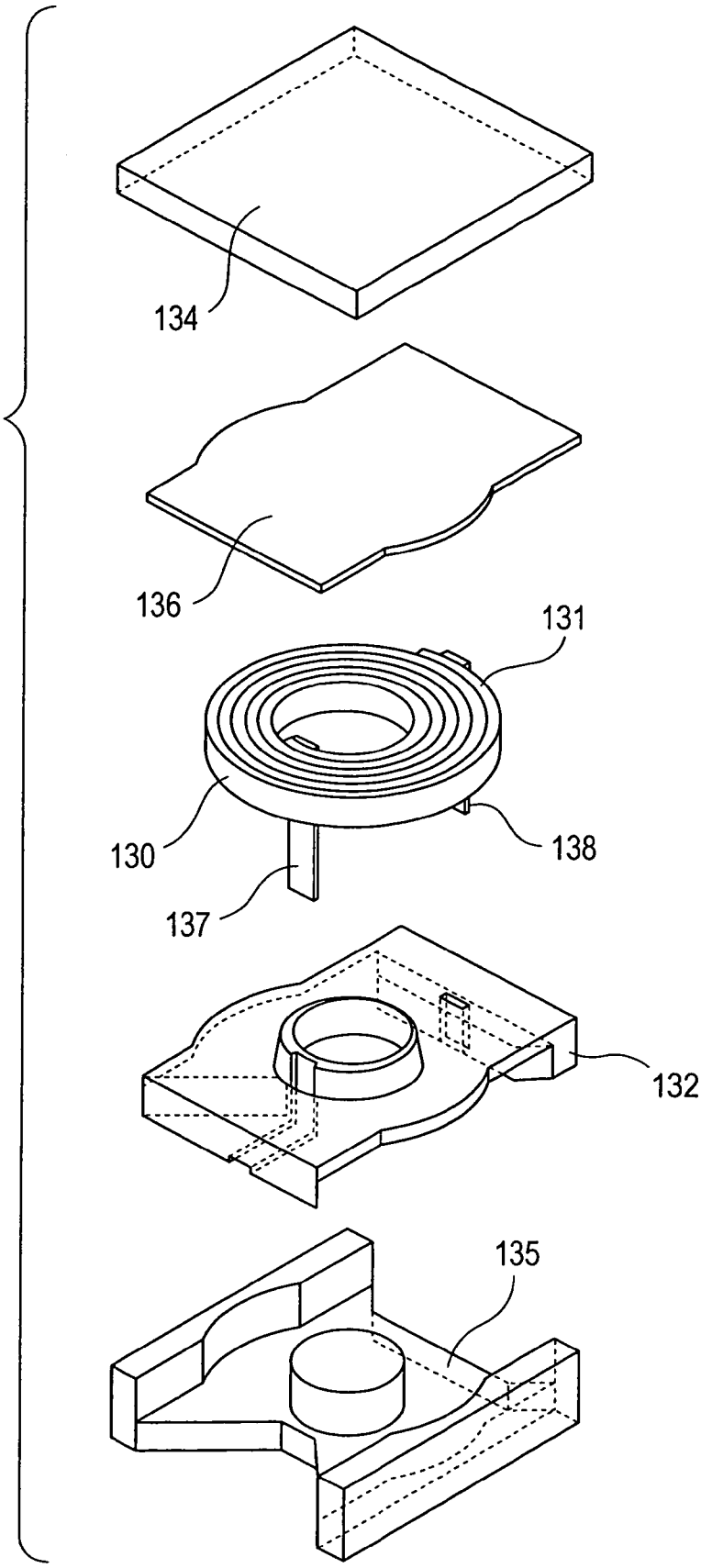
FIG. 15 PRIOR ART
FIG. 15 is an exploded perspective view showing another example of known coil-embedded dust cores.

In the case where the coil main body 2 is compacted by using the device shown in FIG. 7, when the flat type conductor wire 6 constituting the coil main body 2 is made to have an edgewise winding structure in which stacking is performed in the thickness direction, and is compacted with the upper and lower punches 31 and 32 in the thickness direction, since the pressure is applied in the thickness direction of the flat type conductor wire 6, the flat type conductor wire 6 is not cracked nor buckled, so that the soft magnetic alloy powder can be compacted while the coil shape is precisely maintained. On the other hand, if the coil main body shape has a structure in which the flat type conductor wire is horizontally wound as shown in FIG. 15, the pressure is applied in a direction causing buckling of the flat type conductor wire and, therefore, the original shape of the coil main body may not be precisely maintained. If the terminal portions 9 and 10 of the coil main body 2 are not protruded to the bottom surface side of the dust core 1 in the structure, but are protruded to both side surface sides of the dust core 1, it tends to become difficult to compact the dust core through one time of compaction operation, and problems occur in that two times of compaction operation are required as in the known structure described above with reference to FIG. 10 and FIG. 11, and the frame must be divided into two, upper and lower parts.

On the other hand, the coil-embedded dust cores A and B having the structure according to the present invention can be produced through one time of compaction operation, the frame is not necessarily divided into two, upper and lower parts, and the production can be performed in the condition that there is no probability of deformation of the coil main body 2. Therefore, there is an effect that the production can be very easily performed.

In the above-described examples, methods for producing the coil-embedded dust cores A and B by the use of the device having a structure shown in FIG. 7 are explained. However, the coil-embedded dust cores A and B may be produced by other methods disclosed in the above-described Japanese Unexamined Patent Application Publication No. 2001-267160, Japanese Unexamined Patent Application Publication No. 2004-153068, and the like, as a matter of course.

That is, the present invention does not regulate or limit the methods for producing the above-described coil-embedded dust cores A, B, and C. As a matter of course, the coil-embedded dust cores A, B, and C may be produced by performing two times of compaction treatment, and through the use of the frame divided into two, the upper and lower parts, as in the known production methods. Since the coil-embedded dust core C cannot be produced with the above-described device shown in FIG. 7, the method in which the mold divided into two, the upper and lower parts, is used, or the compaction is performed over two times may be adopted. Since the coil-embedded dust core C has a structure in which the flat type conductor wire 6 is wound edgewise, the feature that the soft magnetic alloy powder under the coil conductor 20 flow smoothly and denser compaction can be performed in the case where the coil-embedded dust core C is produced through compaction is similar to that of the coil-embedded dust cores A and B in the above-described embodiments.

In the coil-embedded dust core having the structure according to the present invention, the terminal portion may be extended in any direction of the dust core 1.

Figure 8:
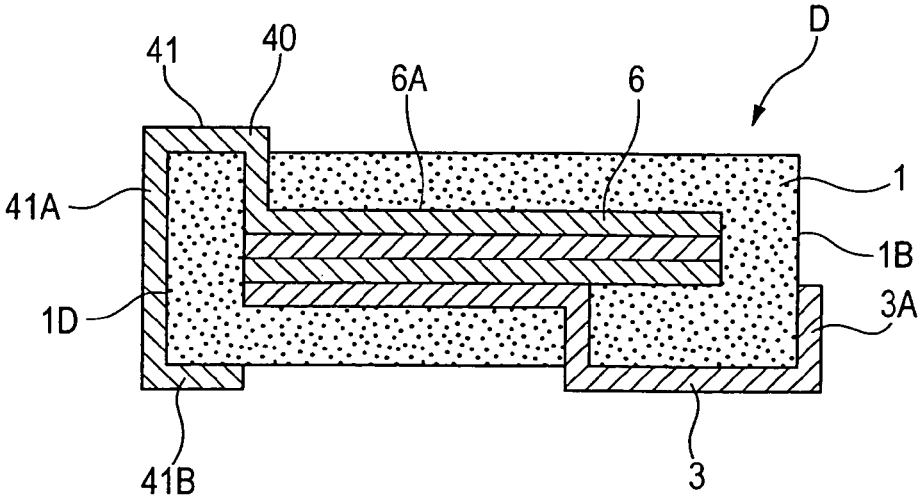
FIG. 8 is a sectional view showing a coil-embedded dust core according to a fourth embodiment of the present invention.

For example, as in the structure of the fourth embodiment shown in FIG. 8, the one terminal portion 3 or 3A may be equal to that in the structure of the first embodiment shown in FIG. 2. The other terminal portion 40 may be bent not downward, but bent upward, to reach the top surface side of the dust core 1. A leading terminal portion 41 may be formed along the top surface of the dust core 1, and the end portion 41A thereof may be bent along the side surface 1D and the bottom surface of the dust core 1, so that an electrode portion 41B is formed. In this manner, electrode portions may be formed on both the top and the bottom sides of the dust core 1.

Figure 9:
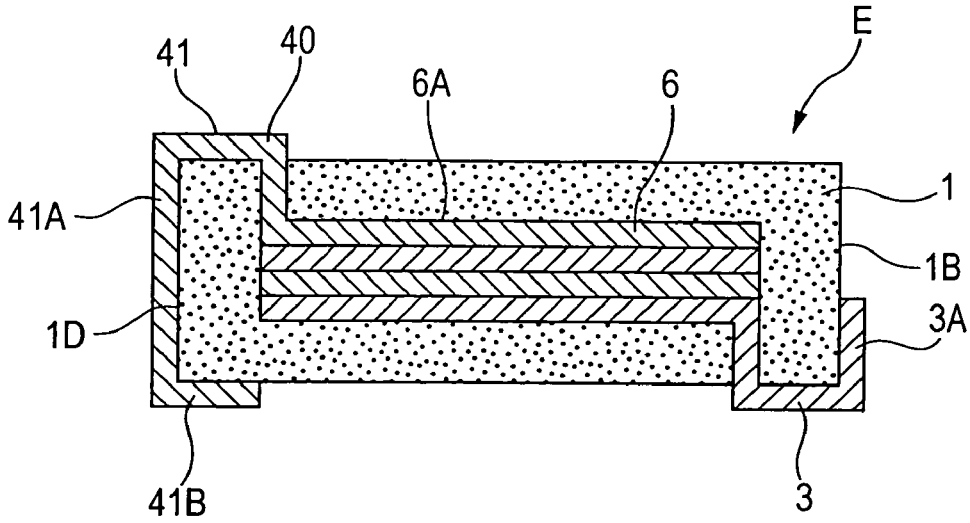
FIG. 9 is a sectional view showing a coil-embedded dust core according to a fifth embodiment of the present invention.

Furthermore, as in the structure of the fifth embodiment shown in FIG. 9, the one terminal portion 3 or 3A may be equal to that in the structure of the first embodiment shown in FIG. 2 except that the leading position is slightly changed. The other terminal portion 40 may be bent upward to reach the top surface side of the dust core 1. A leading electrode portion 41 may be formed along the top surface of the dust core 1, and the end portion 41A thereof may be bent along the side surface 1D and the bottom surface of the dust core 1, so that an electrode portion 41B is formed. In this manner, electrode portions may be formed on both the top and the bottom sides of the dust core 1.

As described above, in the present invention, the position and the direction of leading of the terminal portion is not specifically limited, and can be set at the required position in accordance with the substrate or circuit on which the mounting is performed. In the case where the terminal portion is disposed while being divided and extended upward and downward, the device may be appropriately changed to easily perform the operation. For example, a storage hole is formed in each of the upper punch and the lower punch shown in FIG. 7, each terminal piece of the coil main body 2 extending upward or downward is stored in the hole, and a soft magnetic alloy powder is filled in, followed by compacting.

EXAMPLE

A mixed powder was used, in which 95.7 percent by weight of soft magnetic alloy powder having a composition of $Fe_{74.9}Ni_3Sn_{1.5}P_{10.8}C_{8.8}B_1$, 4 percent by weight of acrylic acid resin, and 0.3 percent by weight of lubricant were mixed. The soft magnetic alloy powder used here was a powder produced by quenching an alloy melt having the above-described composition ratio. The powder was in an amorphous state and had a particle diameter of 3 to 150 μm.

A flat type conductor wire made of Cu of 0.4 mm in thickness and 1.5 mm in width was edgewise wound 5 turns to form a coil main body having an inner diameter of 4.1 mm and an outer diameter of 7.9 mm. The flat type conductor wire at the end portion of the uppermost layer of the coil main body was bent downward, the flat type conductor wire at the end portion of the lowermost layer was bent downward, and the resulting coil was set in the device shown in FIG. 7. The above-described mixed powder was filled in around the coil, and a pressure of 10 t/cm$^2$ (=about 1 GPa) was applied from the upper punch to compact, so that a coil-embedded dust core having the configuration shown in FIG. 1 and FIG. 2 was produced.

The thickness of the dust core portion located above the uppermost layer of the coil main body was 0.75 mm, the thickness of the dust core portion located below the lowermost layer of the coil main body was 0.75 mm, and the thickness of the dust core portion from the outer perimeter portion of the coil main body to the side surface of the dust core was 1.05 mm. A plurality of samples in the same shape were prepared. In every sample, no cracking nor chipping occurred in the dust core portion.

Each of the resulting coil-embedded dust cores was subjected to an energization test. As a result, a magnetic field in accordance with the designed value was able to be generated. The distribution of magnetic field was examined. As a result, particularly abnormal irregularity was not observed in the distribution of magnetic field. Therefore, it was evaluated that the compaction of soft magnetic alloy powder was able to be performed while the desired coil shape in accordance with the designed value was ensured.

What is claimed is:

1. A coil-embedded dust core comprising:

a molded coil component including a coil main body having an edgewise winding structure in which a flat type conductor wire having a flat portion is wound in such a way that the flat portion is arranged substantially perpendicularly to a winding axis, wherein one end side terminal portion is disposed by leading an end portion of the flat type conductor wire located on the one end side of the coil main body in parallel to the winding axis of the coil main body, the other end side terminal portion disposed by leading an end portion of the flat type conductor wire located on the other end side of the coil main body in parallel to the winding axis of the coil main body, wherein one end side leading electrode portion is disposed by extending the one end side terminal portion, and the other end side leading electrode portion is disposed by extending the other end side terminal portion;

a dust core composed of a soft magnetic alloy powder compact disposed covering the coil main body, the one end side terminal portion, and the other end side terminal portion of the molded coil component;

wherein the one end side terminal portion and the other end side terminal portion are extended to one surface or the other surface of the dust core, the surfaces being perpendicular to the winding axis direction of the coil main body; and wherein the one end side leading electrode portion that is extended from the one end side terminal portion lead to the one surface or the other surface of the dust core is extended along the dust core surface to a corner portion side of the dust core, and is bent so that the one end side leading electrode portion is exposed.

2. The coil-embedded dust core according to claim 1, wherein the coil main body is low-profile, and the dust core covering the coil main body is low-profile.

3. The coil-embedded dust core according to claim 1, wherein the other end side leading electrode portion that is extended from the other end side terminal portion leads to the one surface or the other surface of the dust core is extended along the dust core surface to a corner portion side of the dust core, and is bent so that the other end side leading electrode portion is exposed.

4. The coil-embedded dust core according to claim 1, wherein both the one end side terminal portion and the other end side terminal portion are extended to one surface of the dust core, the other end side terminal portion being kept a distance from an outer perimeter portion of the coil main body in the inside of the dust core to the one surface, and a part of the soft magnetic alloy powder compact is filled in between the outer perimeter portion of the coil main body and the other end side terminal portion.

* * * * *